US009659532B2

(12) United States Patent
Miller et al.

(10) Patent No.: US 9,659,532 B2
(45) **Date of Patent: *May 23, 2017**

(54) FOUR-CHANNEL TRANSMISSIVE DISPLAY SYSTEM

(71) Applicant: Global OLED Technology LLC, Herndon, VA (US)

(72) Inventors: Michael E. Miller, Xenia, OH (US); Christopher J. White, Avon, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/133,603

(22) Filed: Apr. 20, 2016

(65) Prior Publication Data

US 2016/0247462 A1 Aug. 25, 2016

Related U.S. Application Data

(63) Continuation of application No. 14/629,133, filed on Feb. 23, 2015, now Pat. No. 9,343,040, which is a continuation of application No. 12/397,500, filed on Mar. 4, 2009.

(51) Int. Cl.
*G09G 5/02* (2006.01)
*G09G 3/34* (2006.01)
(Continued)

(52) U.S. Cl.
CPC ..... *G09G 3/3413* (2013.01); *G09G 3/2003* (2013.01); *G09G 3/3607* (2013.01); *G09G 5/02* (2013.01); *G09G 5/04* (2013.01); *G09G 5/10* (2013.01); *G09G 3/3208* (2013.01); *G09G 2300/0452* (2013.01); *G09G 2320/0233* (2013.01); *G09G 2320/0271* (2013.01); *G09G 2320/041* (2013.01); *G09G 2320/0613* (2013.01); *G09G 2320/0626* (2013.01); *G09G 2320/0666* (2013.01); *G09G 2330/021* (2013.01); *G09G 2360/144* (2013.01)

(58) Field of Classification Search
None
See application file for complete search history.

(56) References Cited

U.S. PATENT DOCUMENTS 4,338,623 A 7/1982 Asmus et al.
5,598,565 A 1/1997 Reinhardt
(Continued)

*Primary Examiner* — Benjamin C Lee
*Assistant Examiner* — David Lee

(57) ABSTRACT

A four-color transmissive display system incorporates a display having independently variable light sources for different colors, and a controller. The controller is configured to receive and process a three-color input image signal, and provide a four-color output image signal to the display. The controller incorporates units respectively configured to (1) calculate a blue reduction factor for each pixel, dependent on luminance differences between blue and other color components, (2) produce respective saturation adjustment factors for red, green, and blue, (3) apply the blue reduction factor to reduce blue luminance, and apply the saturation adjustment factors to reduce saturation of other colors, (4) produce the output image signal. An optional sensor is operable to provide a control signal to the controller, whereby display power can be reduced. An optional estimating unit is configured to estimate current required to display the input image signal, for adjustment of the output image signal.

14 Claims, 6 Drawing Sheets

(51) Int. Cl.

| | |
|---|---|
| ***G09G 3/20*** | (2006.01) |
| ***G09G 5/10*** | (2006.01) |
| ***G09G 3/36*** | (2006.01) |
| ***G09G 5/04*** | (2006.01) |
| *G09G 3/3208* | (2016.01) |

(56) References Cited

U.S. PATENT DOCUMENTS

| | | | | |
|---|---|---|---|---|
| 6,496,174 | B2 | 12/2002 | Kurumisawa et al. | |
| 6,801,811 | B2 | 10/2004 | Ranganathan et al. | |
| 6,919,681 | B2 | 7/2005 | Cok et al. | |
| 6,987,355 | B2 | 1/2006 | Cok | |
| 7,184,067 | B2 | 2/2007 | Miller et al. | |
| 7,230,594 | B2 | 6/2007 | Miller et al. | |
| 7,333,080 | B2 | 2/2008 | Miller et al. | |
| 7,397,485 | B2 | 7/2008 | Miller et al. | |
| 7,586,497 | B2 | 9/2009 | Boroson et al. | |
| 7,755,652 | B2 | 7/2010 | Credelle et al. | |
| 7,999,826 | B2 | 8/2011 | Mawatari et al. | |
| 8,004,545 | B2 | 8/2011 | Inuzuka et al. | |
| 8,059,073 | B2 | 11/2011 | Shin et al. | |
| 8,233,013 | B2 | 7/2012 | Morisue et al. | |
| 8,248,430 | B2 | 8/2012 | Hekstra et al. | |
| 8,933,959 | B2 | 1/2015 | Elliott et al. | |
| 9,343,041 | B2 * | 5/2016 | Miller | G09G 3/2003 |
| 2006/0232711 | A1 | 10/2006 | Jaspers | |
| 2007/0120862 | A1 | 5/2007 | Kosuga | |
| 2008/0198180 | A1 | 8/2008 | Langendijk | |

* cited by examiner

FOUR-CHANNEL TRANSMISSIVE DISPLAY SYSTEM

CROSS REFERENCE TO RELATED APPLICATIONS

This patent is a continuation of commonly assigned, co-pending U.S. Ser. No. 14/629,133, filed Feb. 23, 2015, titled "Four-Channel Display Power Reduction With Desaturation" by Miller et al., since published as U.S. 2015-0179136 Al, which is continuation of U.S. Ser. No. 12/397,500, filed Mar. 4, 2009, titled "Four-Channel Display Power Reduction With Desaturation" by Miller et al., since published as U.S. 2010-0225673 A1.

Reference is also made to commonly assigned U.S. Ser. No. 12/172,440, filed Jul. 14, 2008, titled "Method For Improving Display Lifetime" by Miller, since issued as U.S. Pat. No. 8,237,642, and commonly assigned U.S. Ser. No. 12/174,085, filed Jul. 16, 2008, titled "Converting Three-Component To Four-Component Image" by Cok et al., since issued as U.S. Pat. No. 8,169,389, the disclosures of which are incorporated herein by reference.

FIELD OF THE INVENTION

The present invention relates to image processing techniques for presenting images on displays having color channel dependent light emission, and more particularly, to methods, apparatuses, and systems for providing images with reduced power consumption or increased luminance on emissive or transmissive displays having four colors of subpixels.

BACKGROUND OF THE INVENTION

Flat-panel display devices are widely used in conjunction with computing devices, in portable devices, and for entertainment devices. Such displays typically employ a plurality of pixels distributed over a substrate to display images. Each pixel incorporates several, differently-colored subpixels, typically red, green, and blue, to represent each image element. A variety of flat-panel display technologies are known, for example plasma displays, field emissive displays (FEDs), liquid crystal displays (LCDs), and electroluminescent (EL) displays, such as light-emitting diode displays. To present images on these displays, the display typically receives an image input signal containing three-color-components for driving each pixel.

In emissive displays, including plasma, field-emissive and electroluminescent displays, the amount of radiant energy produced by the display is positively correlated with the amount of power that the display consumes, i.e. higher power corresponds to more radiant energy. This same relationship does not exist in transmissive displays, such as LCDs in which the light source is not modulated, as these displays typically create enough light to provide the brightest possible image and then modulate this light so that only the necessary portion of the light is transmitted to the user. However, it is known to produce LCD displays having color channel dependent light emission in which the light emission can be varied for various color channels within various regions. For example, it is known to produce LCD displays employing arrays of addressable, discrete inorganic light-emitting diodes (LEDs) as backlights and to modulate the light emission of these LEDs to affect the power consumption of the display. Within this disclosure, displays having color channel dependent light emission include emissive displays, as well as transmissive displays equipped with light sources in which light emission can be varied independently for different color channels.

These displays having color channel dependent light-emission can be produced by arranging different light-emissive materials that emit different colors of light. However, patterning these materials for some technologies, particularly small-molecule organic EL materials, is difficult for large substrates, thereby increasing manufacturing costs. One approach to overcoming material deposition problems on large substrates is to employ a single emissive material set to form, for example, a white-light emitter, together with one or more color filters in each subpixel for forming a full-color display. Such a display is taught in U.S. Pat. No. 6,987,355 entitled, "Stacked OLED Display Having Improved Efficiency" by Cok. Because the white-light emitter is modulated independently for each subpixel, this display configuration has color channel dependent light emission.

Most commonly available emissive displays employ three colors of subpixels, but it is also known to employ more than three colors of subpixels. For example, a white-light-emitting element can be included an EL display that does not include a color filter for providing a fourth subpixel, for example, as taught in U.S. Pat. No. 6,919,681 entitled, "Color OLED Display with Improved Power Efficiency" by Cok et al. U.S. 2004/0113875 A1 entitled "Color OLED display with improved power efficiency" by Miller et al. teaches an EL display design employing an unpatterned white emitter with red, green, and blue color filters to form red, green, and blue subpixels, and an unfiltered white subpixel to improve the efficiency of the device. Similar techniques have also been discussed for other display technologies.

However, since most display systems provide an image input signal having red, green, and blue color components, it is typically necessary to employ a conversion method to convert an incoming image input signal from three-color-components to a larger number of components for driving displays having four or more colors of EL subpixels. For example, Miller et al., in U.S. Pat. No. 7,230,594 entitled "Color OLED Display With Improved Power Efficiency" describe an OLED display having four light-emitting elements; including red, green, blue and white light-emitting elements together with a discussion of one such method for performing conversion of the image input signal. Miller et al. teach that when the fourth light-emitting element in an emissive OLED display has a higher power efficiency than the red, green, or blue light-emitting elements, light can be created more efficiently when it is produced by the fourth light-emitting element instead of a combination of the three red, green, and blue light-emitting elements. As such, it is possible to control the power consumption of the display by controlling the proportion of light that is produced by the red, green, and blue light-emitting elements as opposed to the white subpixel.

Miller et al. in U.S. Pat. No. 7,397,485 entitled, "Color OLED Display Having Improved Performance" further describes an emissive OLED display in which power consumption of the display can further be reduced by reducing the saturation of the displayed image under certain conditions indicated by a control signal and then using a white subpixel to provide an additional proportion of the display luminance to further reduce the power consumption of the display.

Power reduction in emissive displays can also be achieved by reducing the luminance level of the display. For example, Reinhardt in U.S. Pat. No. 5,598,565, entitled "Method And Apparatus For Screen Power Saving" discusses reducing the power to a subset of the light-emitting pixels on the display to reduce the power consumption of the display. This patent discusses determining pixels that are not critical to the task at hand and reducing the power to these pixels, which reduces the luminance of the pixels and the visibility of this portion of the display but does so only for pixels that are deemed to be less important to the user. A method for achieving a similar result is further discussed by Ranganathan et al. in U.S. Pat. No. 6,801,811, entitled "Software-Directed, Energy-Aware Control Of Display".

Similarly, it is known to reduce the power of emissive displays under other conditions. For example, Asmus et al. in U.S. Pat. No. 4,338,623, entitled "Video Circuit with screen-burn-in protection", issued Jul. 6, 1982 discusses a CRT display which includes a circuit for detecting a static image decreasing the brightness of the displayed image when the image is static for at least a predetermined time period. This method is disclosed with the purpose of reducing image stick artifacts, but decreases the power of the display under conditions when the display is not updated after a period of time.

In the methods for reducing the power of emissive displays through a method of driving, reducing the color saturation or luminance of the display reduces the image quality of the resulting images. Significantly reducing the luminance of the display reduces the display contrast reducing the ability of the user to see detailed information, such as text on the display. Reducing saturation of all color channels can reduce the image quality by producing washed out images.

There is a need to reduce the power consumption of EL displays without significantly reducing image quality. Further, it is desirable to increase the luminance of the display under certain circumstances, such as conditions of high ambient illumination conditions.

SUMMARY OF THE INVENTION

According to the present invention, there is provided a method of presenting an image on a display device having color channel dependent light emission comprising:

(a) receiving an image input signal including a plurality of input pixel signals, each input pixel signal having three color components;
(b) selecting a reduction color component;
(c) calculating a reduction factor for each input pixel signal dependent upon a distance metric between the input pixel signal and the selected reduction color component;
(d) selecting a respective saturation adjustment factor for each color component of each pixel signal;
(e) producing an image output signal having four color components from the image input signal using the reduction factors and saturation adjustment factors to adjust the luminance and color saturation, respectively, of the image input signal;
(f) providing a four-channel display device having color channel dependent light emission; and
(g) applying the image output signal to the display device to cause it to present an image corresponding to the image output signal.

DETAILED DESCRIPTION OF THE INVENTION

Figure 1:
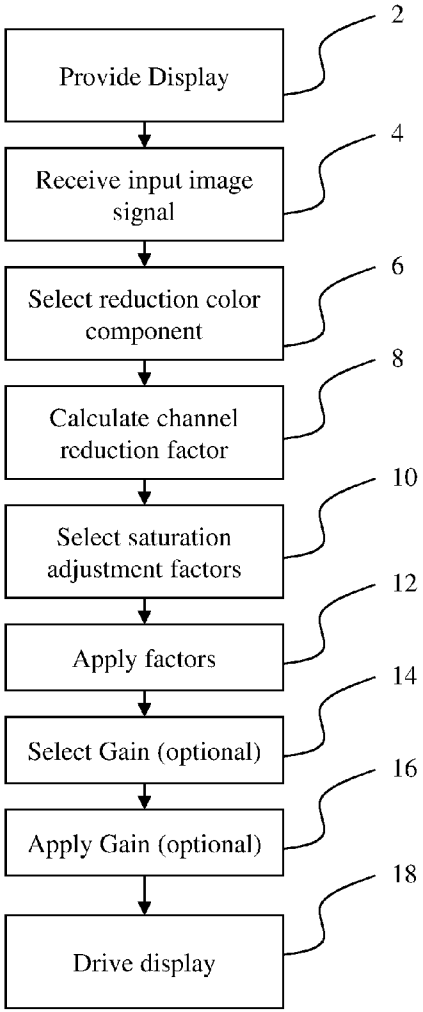
FIG. 1 is a flow chart depicting a method of the present invention.

A method is provided for presenting an image on a display having color channel dependent light emission to reduce the power consumption of the display. This method includes the steps shown in FIG. 1. As shown an image input signal is received 2. This image input signal includes a plurality of input pixel signals, each input pixel signal having three color components. A reduction color component is selected 4 for reduction. A reduction factor is calculated 6 for each input pixel signal dependent upon a distance metric between the input pixel signal and the selected reduction color component. A respective saturation adjustment factor is selected 8 for each color component of each pixel signal. An image output signal is produced 10 having four color components from the image input signal using the reduction factors and saturation adjustment factors to adjust the luminance and color saturation, respectively, of the image input signal. A four-channel emissive display device is provided 12. The image output signal is applied 14 to the display device to cause it to present an image corresponding to the image output signal. In some embodiments, the selected reduction color component is a low luminance color component, including a blue color component such that the reduction in luminance is less visible to provide reduced power without significantly decreasing the perceived image quality of the display.

FIG. 1 shows two additional steps, including selecting 16 a luminance gain and producing 10 the image output signal further using the selected luminance gain to adjust the luminance of the image input signal. When these two additional steps are added, the method can provide an emissive display having an increased luminance. This increase in luminance can be achieved without adjusting the luminance range of the display by methods such as changing the voltage in an electroluminescent display.

Figure 2:
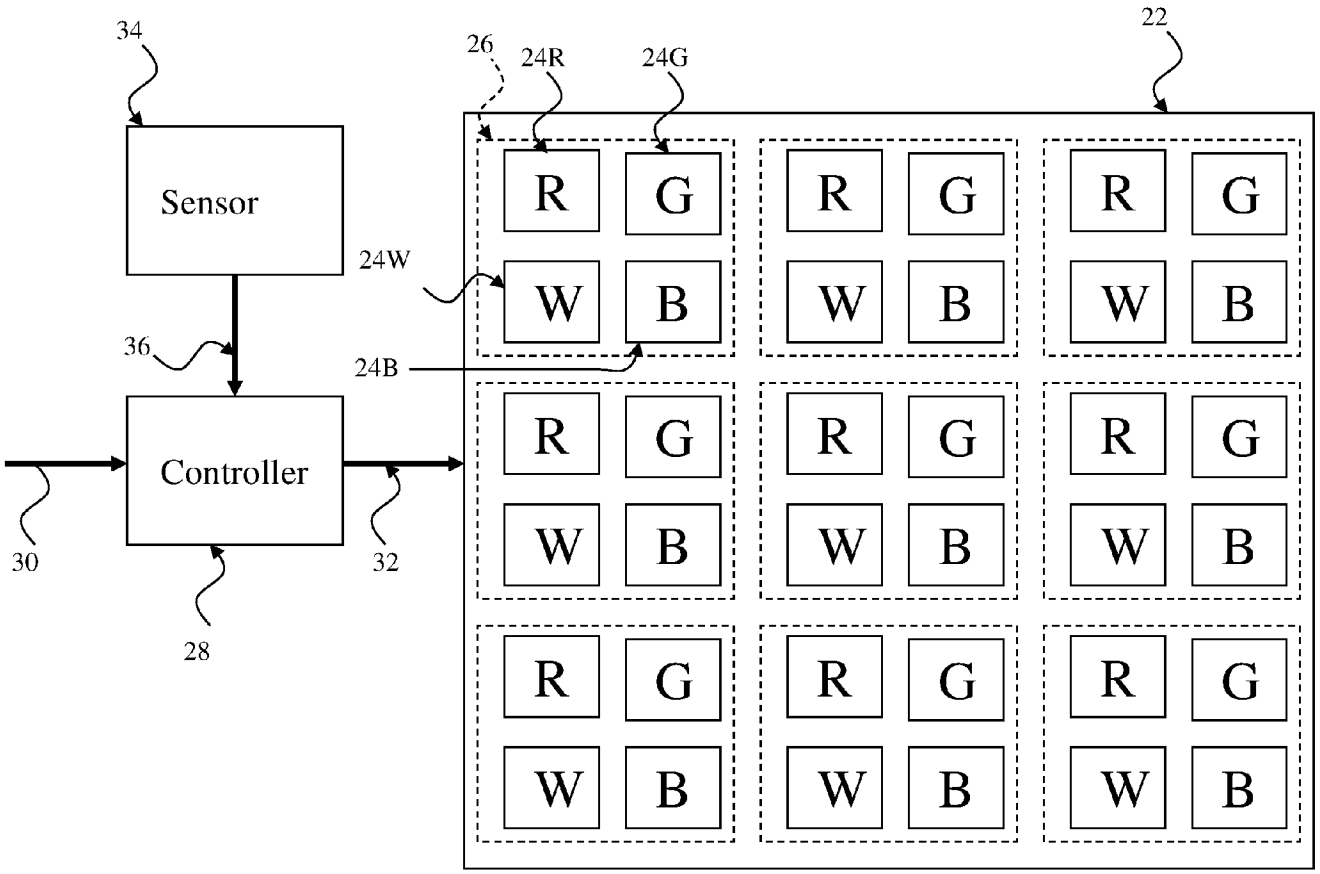
FIG. 2 is a schematic diagram of an emissive display system useful in practicing the method of the present invention.

The method of the present invention can be employed in a display system, such as shown in FIG. 2. In an embodiment of such a display system, a controller 28 receives (Step 2 in FIG. 1) an image input signal 30, processes the image input signal to produce (Step 10 in FIG. 1) an image output signal 32. The image output signal 32 is then applied (Step 14 in FIG. 1) in a display device 22 to drive the red 24R, green 24G, blue 24B, and white 24W subpixels within pixels 26 of the display device 22, which can be a four-channel emissive display device.

Figure 3:
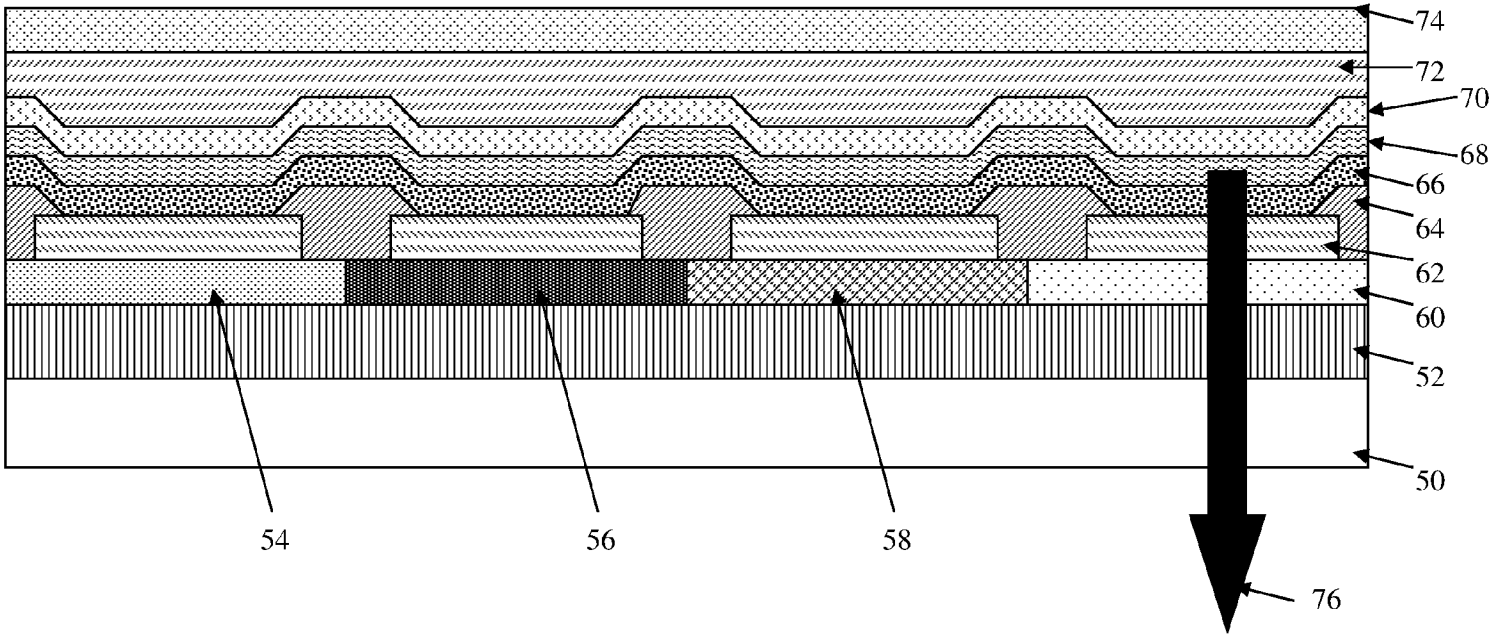
FIG. 3 is a cross sectional diagram of a four-channel emissive organic light emitting diode display device useful in practicing the method of the present invention.

A detailed embodiment of the method of the present invention will be provided to further explain the invention and to illustrate its merits. In the method of the current invention, a four-channel emissive display is provided 12. This display can be any display having an array of subpixels that include four different colors of subpixels, which emit light in response to a modulated signal, typically a voltage or current signal. For example, this display can be an electroluminescent display, such as an organic light emitting diode (OLED) display, which has red, green, blue and white subpixels, which produce light in proportion to the current that is passed through each subpixel. These subpixels can be formed from a single plane of organic material, which emits white light, and an array of red, green, blue, and clear color filters that permit the subpixels to produce red, green, blue and white light. A cross section of such a display is depicted in FIG. 3. As shown in this figure, the OLED display is formed on a substrate 50. On this substrate 50 is formed an active matrix layer 52, which contains active matrix circuitry for providing a current to each subpixel. A patterned array of color filters 54, 56, 58, and optionally 60 are formed. The color filters 54, 56, 58, and 60 can be formed between the substrate 50 and a light-emitting layer 68. These color filters include red 54, green, 56, and blue 58 color filter materials. It can also include a clear, neutral-colored, or slightly colored filter 60 over the white subpixel to provide planarization. The color filter 60 can be an organic planarization material rather than a pigmented or dyed filter material, or can be omitted. A first array of electrodes 62 is formed over the color filters and connected to the active matrix layer 52, through vias. Pixel definition elements 64 are formed between and partially overlapping the electrodes 62. Above these electrodes 62 a continuous plane of organic materials is formed, typically including a hole transport layer 66, a light-emitting layer 68, and an electron transport layer 70. Other layers, including hole and injection layers can also be provided as is well known in the art. A second electrode layer 72 is then formed and finally an encapsulation layer 74 is formed over the second electrode layer 72. In this device structure, an electric field is provided between a segment of electrode 62 and the second electrode 72, and current flows through the OLED materials between these electrodes producing light. This light is directed substantially parallel to vector 76 and the desired spectral components of this light pass through the color filters 54, 56, 58, and optionally 60 to produce the desired color of light. In the red, green and blue subpixels 24R, 24G, 24B, undesired spectral components of the produced light are absorbed by the color filters 54, 56, 58, reducing the radiant and therefore the luminous efficiency of the light that is emitted through the narrowband red 54, green 56 and blue 58 color filters.

Each of these subpixels will have a radiant and a luminous efficiency. In this example, wherein the light produced by the red, green, and blue light emitting elements is filtered, both the radiant and luminous efficiency of the subpixels for producing white light will be higher than the radiant and luminous efficiency of the red, green, and blue subpixels since these subpixels employ the same light-emitting material but the efficiency of the red, green, and blue subpixels is reduced by the color filters. Additionally, each of these subpixels will produce a color of light, which can be quantified using, for example, CIE 1931 x, y chromaticity coordinates and a peak luminance, which is dictated by the maximum current the display system can provide to each subpixel. Finally, the display will have a white point, defined as the color at which an input neutral is rendered on the display. In this example, the white point of the display will be assumed to be D65, having chromaticity coordinates of 0.3127, 0.3290. The display also has a display white point luminance defined as the maximum luminance reproducible at the white point chromaticity coordinates using only the three gamut-defining channels (e.g. R, G, B). Luminance efficiencies and CIE 1931 chromaticity coordinates, and peak luminance values for each subpixel in a display of the present invention are provided in Table 1. It can be noted that in this example, it is assumed that each subpixel can receive the same peak current and therefore, the peak luminance for each subpixel is directly proportional to the luminous efficiency of the subpixel.

TABLE 1

| Subpixel Color | Luminous efficiency (cd/A) | x | y | Peak Luminance (cd/m$^2$) | Maximum Panel Intensity |
|---|---|---|---|---|---|
| Red | 4.6 | 0.670 | 0.330 | 139.7 | 1.0 |
| Green | 10.6 | 0.210 | 0.710 | 321.7 | 1.0 |
| Blue | 1.28 | 0.150 | 0.060 | 38.6 | 1.0 |
| White | 32.00 | 0.313 | 0.329 | 1000.0 | 3.0 |

Figure 4:
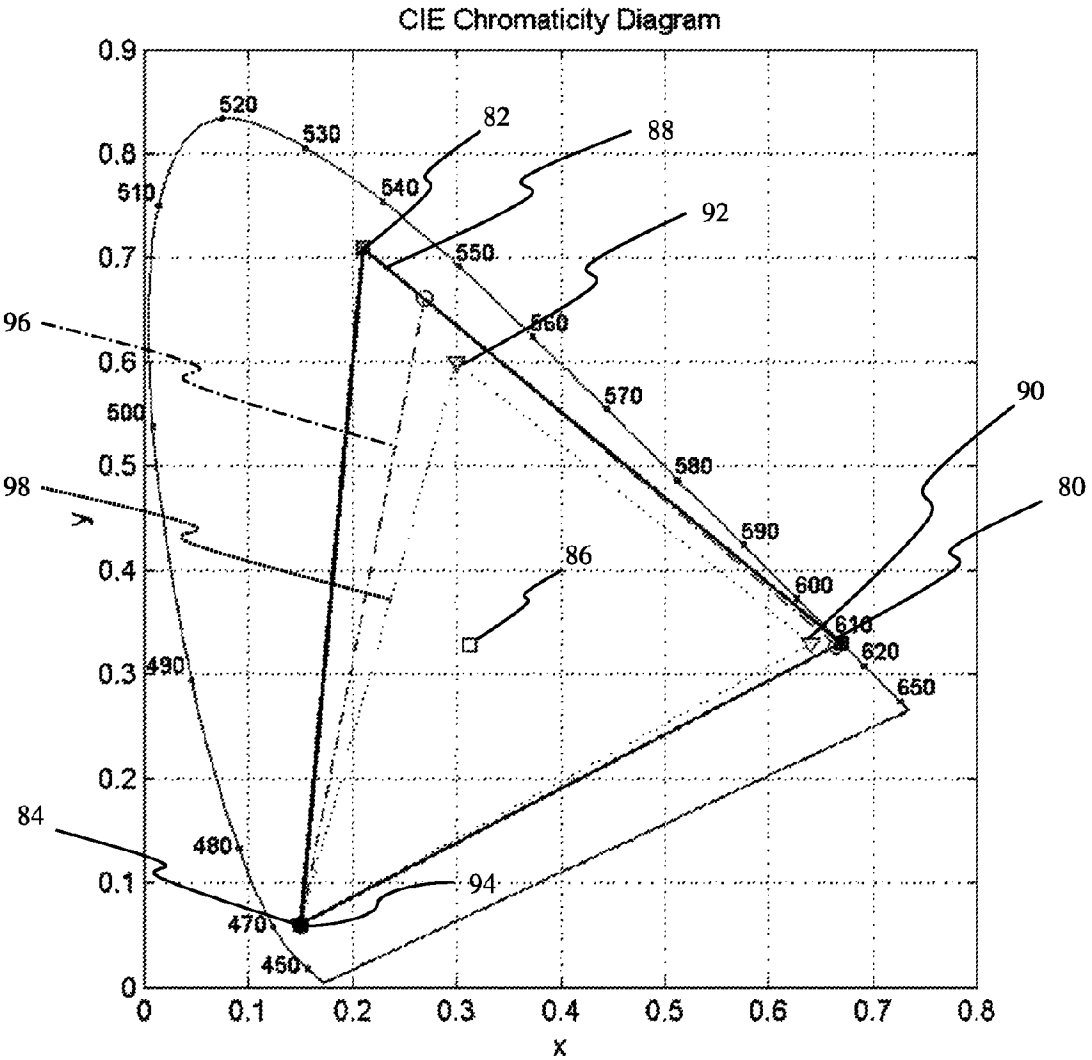
FIG. 4 is a CIE 1931 x,y chromaticity diagram illustrating chromaticity coordinates of subpixels and chromaticity coordinates of standard sRGB color components.

Referring to FIG. 4, a display gamut 88 of a color display is defined by chromaticity coordinates 80, 82, 84 of the red 24R, green 24G, and blue 24B subpixels, respectively. These subpixels are therefore referred to as gamut-defining subpixels. Chromaticity coordinates 86 of the white subpixel 24W are inside the display gamut 88 created by the gamut-defining subpixels. Therefore the four-channel display device will have three gamut-defining channels (e.g., red, green, and blue) and one additional channel (e.g., white) located within the display gamut 88 formed by the three gamut-defining channels, and the additional channel has a higher luminous efficiency than the maximum of the respective luminance efficiencies of the three gamut-defining channels.

The image input signal 30 can be any signal input to the controller that includes a plurality of pixel signals, each input pixel signal having three color components. Typically, this input image signal will be a digital signal but can be an analog signal. The image input signal 30 can include information for displaying individual images. The image input signal 30 can alternately include information for displaying a series of frames from a video image. The pixel signals in the image input signal 30 can represent different spatial locations, which correspond to different pixels 26 on the display device 22. The pixel signals in the image input signal 30 can include red, green, and blue code values. The image input signal 30 can be encoded in any number of standard or other metrics. For example, image input signal 30 can be encoded according to the sRGB standard, providing the image input signal as an sRGB image signal. Table 2 provides a list of some example colors and sRGB code values for rendering these colors. This data will be used to demonstrate the processing steps of this particular embodiment.

TABLE 2

| Color | Red Code Value | Green Code Value | Blue Code Value |
|---|---|---|---|
| Red | 255 | 0 | 0 |
| Green | 0 | 255 | 0 |
| Blue | 0 | 0 | 255 |
| White | 255 | 255 | 255 |
| Dim Yellow | 125 | 125 | 0 |
| Dim Cyan | 0 | 125 | 125 |
| Dim Magenta | 125 | 0 | 125 |

While receiving 4 the image input signal 30, the image input signal can be converted to panel intensity values corresponding to the intensity of each colored subpixel.

Panel intensity values are defined such that a panel intensity value of 1 refers to the proportion of peak luminance from each subpixel that can be used to produce a color with chromaticity coordinates equal to the white point of the display at the maximum luminance when formed from the red, green, and blue subpixels. Since each subpixel produces a different luminance, the panel intensity value is equal to 1 for one of the red, green, or blue color subpixels, but can be greater than 1 for all other subpixels. Table 1 also shows maximum panel intensity values for the display of this example.

The conversion of the image input signal to panel intensity values is a standard manipulation that is well known in the art, and typically includes two steps. First, a tonescale manipulation is performed in which the pixel signals are transformed from a nonlinear tonescale of the input color space (e.g., gamma of 2.2 for sRGB) to a color space that is linear with the luminance output of the display device 22. Second a matrix multiplication is performed which rotates the colors of the image input signal from the input color space (e.g., sRGB) to the color primaries (e.g., the colors of the gamut-defining subpixels) of the display device 22.

Referring to FIG. 4, each input color space has a corresponding input gamut 98. For example, the sRGB (ITU-T Rec. 709) input gamut has chromaticity coordinates of the input colors shown as red 90, green 92, and blue 94. In this example, the chromaticity coordinate of the input blue 94 is the same as the chromaticity coordinate of the blue subpixel 84, but they can be different. The input gamut 98 can be inside the display gamut 88 for most colors. In one embodiment, it is useful to expand the color gamut of the image input signal such that the chromaticity coordinates 90, 92 of the red and green color components of the image input signal are near the chromaticity coordinates 82, 84 of the red and green subpixels. This can be achieved, for example by applying the matrix $$\begin{bmatrix} 0.8699 & 0.1479 & -0.0179 \\ -0.0283 & 1.0621 & -0.0338 \\ 0.0085 & -0.0310 & 1.0226 \end{bmatrix}$$

to the three color components in the image input signal 30 to provide an output gamut 96. Note that these calculations can provide values slightly less than 0 and greater than 1. These values are often clipped to the range [0, 1] to enable easier implementation within the controller. In this embodiment, the image input signal has an input gamut 98 defined as the sRGB gamut and the output image signal has an output gamut 96, wherein the input gamut 98 is a subset of the output gamut 96.

By converting image input signal to panel intensity values, any manipulation of the panel intensity values that will be performed as part of this method will produce a change in the output luminance of the subpixels 24R, 24G, 24B, 24W. For example, lowering a given panel intensity value by a factor of 2 will decrease the luminance output of the corresponding subpixel by a factor of 2. Table 3 provides panel intensity values corresponding to the code values provided in Table 2 with an expanded color gamut.

TABLE 3

| Color | Red Intensity | Green Intensity | Blue Intensity |
|---|---|---|---|
| Red | 0.860 | 0 | 0.009 |
| Green | 0.148 | 1.000 | 0 |
| Blue | 0 | 0 | 1.000 |
| White | 1.000 | 1.000 | 1.000 |
| Dim Yellow | 0.209 | 0.212 | 0 |
| Dim Cyan | 0.027 | 0.211 | 0.203 |
| Dim Magenta | 0.175 | 0 | 0.212 |

A reduction color component is then selected 6. It has been observed that reducing the luminance of color components that are typically low in luminance has little effect on the perceived quality of the displayed image. For instance, reducing the luminance of the blue color component produces little effect on the perceived quality of the displayed images. Therefore, in this example, the blue color component is selected and therefore the selected color component is a blue color component.

A reduction factor is calculated 8 for the image input signal for each pixel dependent upon a distance metric between the image input signal and the selected reduction color component. To calculate 8 this factor, a weighted average of the panel intensity values for the remaining color components (e.g., red and green in this example) can be calculated for each pixel. This value will be denoted as wmean(R,G) in this example. The selected panel intensity value (B) in this example will then be compared to wmean (R,G) for each pixel. If B is less than wmean(R,G) the reduction factor $B_r$ will be assigned a value of 1. Otherwise, it can be computed using the following equation.

$$B_r = 1-(1-L_B)B+(1-L_B)\text{wmean}(R,G)$$

$L_b$ is a blue limit value, which can range from 0 to 1, indicating the minimum blue intensity value that can be applied. The use of a blue limit value of 0.5 will reduce the blue panel intensity values by one half when the difference between B and wmean(R,G) is 1 and will reduce the blue panel intensity values by less than a half for pixels having smaller distances. For illustration purposes, the weighted mean will be computed as three times the red panel intensity value plus one times the green panel intensity value, divided by four. This weighted mean permits dim magenta colors to be reduced more in luminance than cyan colors. Although a weighted mean was discussed in this example, other quantities can alternately be used, including minimum, maximum or simple averages of the panel intensity values for the remaining color components. Table 4 shows calculated 8 reduction factors for each of the colors in Table 3, when calculated according to this embodiment. As will be illustrated in later steps, these reduction factors are applied equally to all panel intensities during the apply factors step 12, to prevent significant hue shifts.

TABLE 4

| Color | Reduction Factor |
|---|---|
| Red | 1.000 |
| Green | 1.000 |
| Blue | 0.500 |
| White | 1.000 |
| Dim Yellow | 1.000 |
| Dim Cyan | 0.816 |
| Dim Magenta | 0.872 |

Saturation adjustment factors can then be selected 10. These saturation adjustment factors can be used to adjust the saturation of one or more of the three color components in the image input signal 30. A respective saturation adjustment factor can be selected for each color component.

The saturation adjustment factors permit mapping the chromaticity coordinates of one or more of the three color components in the image input signals to values inside the color gamut 86 of the display. This can be performed either before or after applying a matrix such as the one shown above to reduce the gamut of one or more of the primaries. A matrix of saturation adjustment factors dsmat can be calculated using the following equation:

$$dsmat = \begin{bmatrix} (R_v & 0 & 0 \\ 0 & G_v & 0 \\ 0 & 0 & B_v \end{bmatrix} + \begin{bmatrix} (1-R_v)R_L & (1-R_v)G_L & (1-R_v)B_L \\ (1-G_v)R_L & (1-G_v)G_L & (1-G_v)B_L \\ (1-B_v)R_L & (1-B_v)G_L & (1-B_v)B_L \end{bmatrix}$$

where $R_v$, $G_v$, $B_v$ are saturation adjustment factors for the red, green, and blue color components, respectively, and $R_L$, $G_L$, $B_L$ are proportions of the luminance values of the red, green, and blue subpixels, respectively, that are necessary to form the white point (luminance and chromaticity) of the display.

For example, the following matrix can be employed with saturation adjustment factors for red and green of 0.7, indicating that 70% of the saturation remains, and a saturation adjustment factor for blue of 1.0, indicating no change.

$$dsmat = \begin{bmatrix} 0.7838 & 0.1930 & 0.0232 \\ 0.0838 & 0.8930 & 0.0232 \\ 0.0000 & 0.0000 & 1.0000 \end{bmatrix}$$

An image output signal having four color components is then produced from the image input signal using the reduction factors and saturation adjustment factors to adjust the luminance and color saturation, respectively, of the image input signal. During this step, the panel intensity values shown in Table 3 are multiplied by their respective reduction factors from Table 4. The matrix provided during the selecting a respective saturation adjustment factor step is then applied to the resulting values. This produces the reduced panel intensity values shown in Table 5.

TABLE 5

| Color | Reduced Red Intensity | Reduced Green Intensity | Reduced Blue Intensity |
|---|---|---|---|
| Red | 0.682 | 0.073 | 0.009 |
| Green | 0.309 | 0.905 | 0.038 |
| Blue | 0.012 | 0.012 | 0.500 |
| White | 1.000 | 1.000 | 1.000 |
| Dim Yellow | 0.204 | 0.207 | 0.000 |
| Dim Cyan | 0.065 | 0.194 | 0.166 |
| Dim Magenta | 0.141 | 0.019 | 0.1845 |

The reduced panel intensity values for the three-color components are then transformed to four color components. In this example, this can be accomplished by determining the minimum of the red, green and blue reduced panel intensity values for each color, assigning this minimum value to the fourth color component and subtracting this value from each of the three reduced panel intensity values to determine the remaining three of the four color components of the image output signal. Through this method, the four-color component image output signal is produced. These values are shown in Table 6 for each of the four-color components.

TABLE 6

| Color | Red Color Component | Green Color Component | Blue Color Component | White Color Component |
|---|---|---|---|---|
| Red | 0.674 | 0.065 | 0.000 | 0.009 |
| Green | 0.309 | 0.905 | 0.000 | 0.000 |
| Blue | 0.000 | 0.000 | 0.488 | 0.012 |
| White | 0.000 | 0.000 | 0.000 | 1.000 |
| Dim Yellow | 0.205 | 0.207 | 0.000 | 0.000 |
| Dim Cyan | 0.000 | 0.129 | 0.101 | 0.065 |
| Dim Magenta | 0.122 | 0.000 | 0.166 | 0.019 |

This four color component image output signal is then applied to the display device to drive the display (drive display step 18), causing it to present an image corresponding to the image output signal. In some embodiments, this step can include performing a mapping through a nonlinear table to create current or voltage signals that are provided to each subpixel 24R, 24G, 24B, 24W of the display device 22.

A comparison can be made between the power consumption of this display when applying the present embodiment, including steps 6 through 12 as compared to the same display without the applying steps 6 through 10 and without applying the reduction factors during step 12 as is known in the prior art. Table 7 shows currents for each display for each color. As shown in this table, the current required to drive the display of the current invention is lower than the current required to drive a display of the prior art, therefore providing a lower power. However, because luminance is reduced for some color components as a function of color saturation and saturation is reduced for other color components, the image quality of the display is improved as compared to prior art examples in which the luminance is reduced for all color components, regardless of saturation or saturation is reduced for all color components.

TABLE 7

| Color | Current (A) of present invention | Current (A) of Prior Art |
|---|---|---|
| Red | 22.68 | 26.67 |
| Green | 36.86 | 34.84 |
| Blue | 15.09 | 30.16 |
| White | 31.25 | 31.25 |
| Dim Yellow | 12.49 | 12.77 |
| Dim Cyan | 8.99 | 11.75 |
| Dim Magenta | 9.30 | 11.68 |

In some applications, it can be desirable to increase the peak luminance of a display. For example, in OLED displays, the peak luminance can be adjusted by adjusting the bulk voltage between the electrodes. However, the ability to adjust this bulk voltage requires the addition of further electrical components to facilitate this adjustment, and requires components capable of providing higher voltage. Each of these modifications increases the cost of the display system and therefore it is desirable to provide luminance adjustment without increasing the bulk voltage of the display.

Referring to Table 3, the panel intensity values for the red, green and blue colors are very near unity. Since the display is not capable of producing panel intensity values over unity, it is not possible to increase these values significantly without requiring larger panel intensity values than can be physically realized by the display. However, Table 6, shows panel intensity values for the red, green, and blue color components that are less than unity. Further, the panel intensity value for the white color component is significantly less than the maximum panel intensity value for the white subpixel 24W. Therefore, it is possible to increase these values without exceeding the capability of the display. Therefore, referring back to FIG. 1, an optional step of selecting a luminance gain 14 can be performed, and that luminance gain can be applied 16 to the image input signals or an intermediate intensity value, such that the resulting values in the four color component image output signal are equal to or only slightly below the corresponding maximum panel intensity values for each channel. An image output signal can be provided by using the selected luminance gain to adjust the luminance of the image input signal. By using this method an image output signal can be provided having four color components with a higher luminance.

Figure 5:
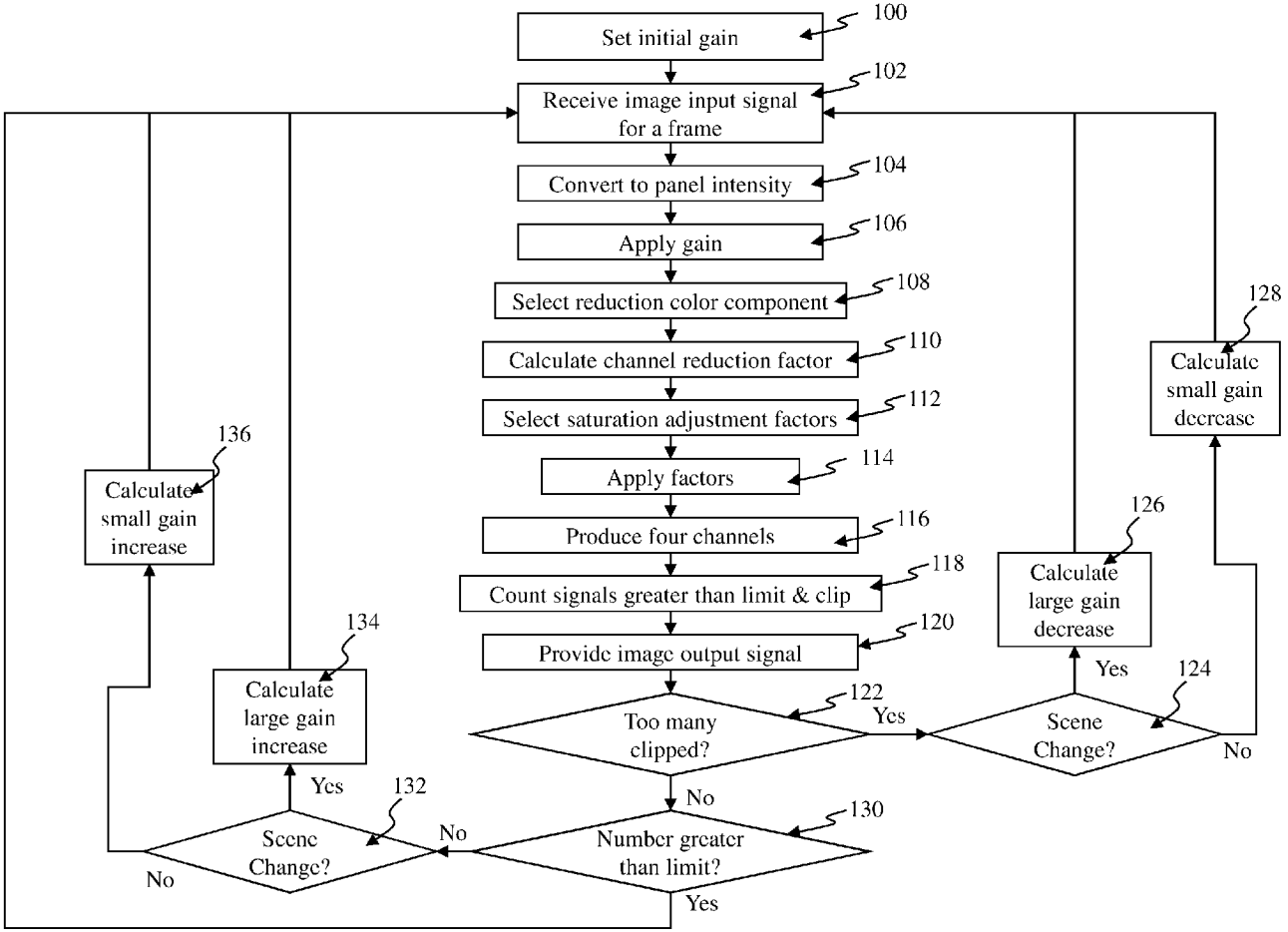
FIG. 5 is a flow chart depicting a method of the present invention for use when the image input signal is a series of video frames.

This method can be applied when the image input signal provides individual images, or when the image input signal provides a video signal. FIG. 5 shows a modified version of the method for use when the image input signal is a video. As shown in this figure, an initial luminance gain is set 100. The image input signal is received 102 for a frame in the video. The image input signal is then converted 104 to panel intensity values and the luminance gain is applied 106 to the panel intensity values. The reduction color component is then selected 108 as described earlier. As before the channel reduction factor is calculated 110 for each input pixel signal represented by the panel intensity values for each pixel. A saturation adjustment factor is then selected 112 for each color component. In this embodiment, the saturation adjustment factor is a global saturation factor for at least a frame of the video and the saturation adjustment factor for each color component of each pixel signal is equal to the global saturation factor. The channel reduction factor and the saturation adjustment factors are then applied 114. The resulting three color components within each input pixel signal for each pixel in a frame of the image input signal is then converted to produce 116 an image output signal having four color components. The number of the resulting color component values that are greater than the maximum panel intensity value for each subpixel is then counted and these values are clipped 118 to the maximum possible value. The image output signal is then provided 120 to the four-channel emissive display device to cause it to present an image corresponding to the image output signal for a frame in the video. If the number of color component values is determined 122 to be greater than a threshold, it is determined that it is necessary to reduce the luminance gain. Calculations, for example calculation of an average intensity value and comparison to an average intensity value for a previous frame, are then performed to determine if a scene change has occurred 124 since the last frame was displayed. If the scene change has occurred, then a luminance gain value is calculated 126 using a large luminance gain decrease by calculating the maximum luminance gain that can be applied without clipping values within the frame. If a scene change has not occurred, then a luminance gain is calculated 128 using a small gain decrease, permitting the luminance gain to be reduced by only a couple percent, such that an instantaneous change in luminance of the display will not be seen. Returning to step 122, if too many of the color component values are not clipped, a check is performed to determine the number of color component values that are greater than a second threshold. If this number is larger than the second threshold, the luminance gain is unchanged and the process, including steps 102 through 130 is repeated for the next frame in the video. If this number is smaller than the second threshold, the luminance gain is increased. However, to increase the luminance gain, a determination 132 is again made as to whether a scene change has occurred. If it has, a large luminance gain is calculated 134 using a large gain increase such that the maximum luminance gain is determined to avoid clipping. If a scene change has not occurred as determined 132, a luminance gain is calculated 136 using a small gain increase. Once again, this small gain increase is limited to only a few percent to avoid the visibility of a rapid change in luminance within a scene. The process, beginning with step 102 is again applied for the next frame of video within the image input signal. Through this method, the same luminance gain is applied to all pixel signals within each frame of the video but a different luminance gain can be applied to pixel signals within different frames of the video within the image input signal. Important in this method is the ability to reliably detect large changes in scene content and to employ both a fast change in gain value when a large change in scene content occurs and a slow change in gain value when such a large change in scene content does not occur. This dual rate is necessary to achieve large but unobtrusive changes in display luminance through adjustment of this luminance gain value.

It should be noted that the method shown in FIG. 5 permits the selected luminance gain to be dependent upon the image input signal, the reduction factors and saturation adjustment factors. This is achieved since the channel reduction factors and the saturation adjustment factors influence the portion of the signal that is reproduced with the red, green, and blue subpixels. That is decreases in the channel reduction factors or the saturation adjustment factors will reduce the maximum values within the red, green, or blue channels after the four channels are produced 116. Therefore, higher luminance gain values are achievable when higher reduction and saturation adjustment factors are employed, permitting the average luminance of the display to be increased. This selected luminance gain value is also dependent upon the image input signal since larger gains can be employed for all images, which contain little or few high value, highly saturated colors. It should be noted that this change in selected luminance gain value permits the luminance of the display as a function of scene content, the reduction and saturation adjustment factors without adjusting the bulk voltage of the display. Therefore, this method can further include providing a fixed bulk voltage for the display device and also providing for a luminance adjustment.

The method of the present invention can further include providing a sensor for providing a control signal responsive to one or more of the ambient illumination, the temperature of the display device, or the average current of the display device, wherein the reduction factor or saturation adjustment factor is further dependent upon the control signal. For instance, a sensor 34 in FIG. 2 can detect the ambient illumination level and provide a control signal 36 to the controller 28. Under high ambient illumination conditions, the controller can decrease the reduction and saturation adjustment factors and therefore provide larger selected luminance gains to be applied to increase the luminance of the display under these high illumination conditions. As such, the method includes providing the sensor 34 for providing a control signal 36 responsive to one or more of the ambient illumination, the temperature of the display device, or the average current of the display device, wherein the selected luminance gain is further dependent upon the control signal 36. Similarly, the sensor 34 can detect high display temperatures or high average current values and employ smaller reduction and saturation adjustment factors without adjusting the selected luminance gain to reduce the total current required to the display, thus decreasing the average current to the display, which will typically decrease the temperature of an emissive display.

In other embodiments, sensors 34 can be provided for producing a control signal 36 responsive to one or more of a battery lifetime signal, a power type signal or an input type signal, wherein the reduction factors or the saturation adjustment factors are further dependent upon the control signal. In such embodiments, the selected reduction color component can be a blue color component and the saturation adjustment factors of red and green can be less than unity. In such embodiments, the method can be used to reduce the power to the display when the battery lifetime is low (e.g., the battery is low on power) or when a limited power type (e.g., battery) is applied. Additionally, the sensor 34 can detect the presence of a particular image type, for example, a graphics screen as opposed to an image and adjust the control signal based upon this result.

Figure 6:
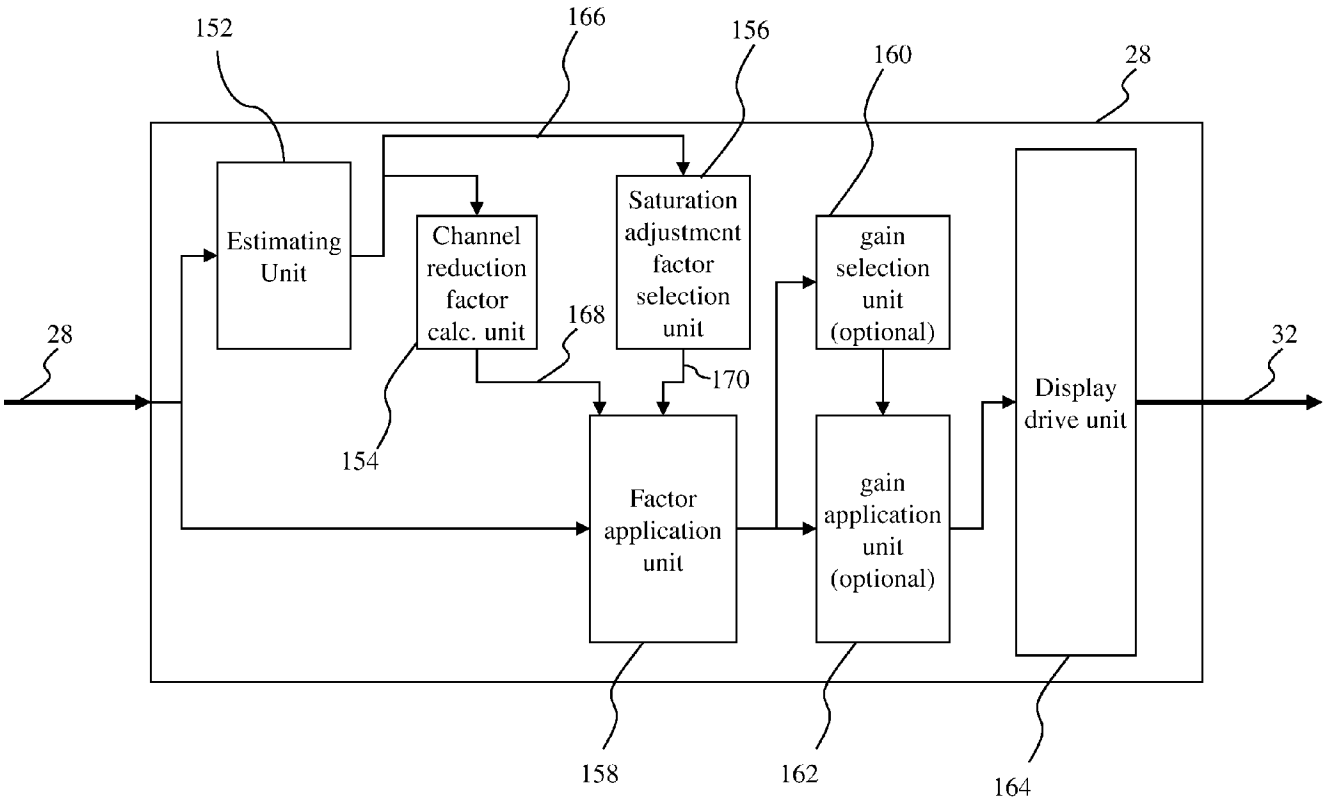
FIG. 6 is a block diagram of a controller useful in an embodiment of the present invention.

Sensor 34 can be used to produce such a control signal 36. An estimating unit can also be employed for producing a control signal using the image input signal, wherein the reduction factors or the saturation adjustment factors are further dependent upon the control signal. That is, the controller 28 can include components as shown in FIG. 6, including an estimating unit 152, a channel reduction factor calculation unit 154 and a saturation adjustment factor selection unit 156. In this embodiment, the estimating unit 152 receives the image input signal 30, estimates the current required to display the image input signal and produces a control signal 166, which is provided to the channel reduction factor calculation unit 154 or the saturation adjustment factor selection unit 156. In response to this control signal 166, the channel reduction factor calculation unit 154 and the saturation adjustment factor selection unit 156 produce channel reduction factors 168 and saturation adjustment factors 170, respectively. These factors are applied by a factor application unit 158. An optional gain selection unit 160 and an optional gain application unit 162 can also be used to select and adjust the luminance gain of the image. The resulting signal is then provided to a display drive unit 164 to produce the image output signal 32. In this embodiment, the estimating unit 152 can analyze the image input signal to estimate the current of the display and provide the control signal 166 to the channel reduction factor calculation unit 154 or the saturation adjustment factor unit 156 to affect the image that is presented.

In one embodiment, the selected reduction color component is a blue color component, the saturation adjustment factors are less than unity, and the selected luminance gain is greater than unity. The saturation adjustment factors for the selected reduction color component are preferably unity (1.0) as the use of the reduction factor permits a reduction in the maximum value of this color channel without requiring that the saturation of the channel be reduced.

Although the embodiments as provided have employed a global saturation factor for each image input signal or frame of video within the image input signal, it is also possible to select a respective pixel saturation factor for each pixel and to select the saturation adjustment factors for each pixel signal independently. For example, the saturation adjustment factors can be selected to be equal to the respective pixel saturation factors. The respective pixel saturation factors can be computed as a distance metric between the image input signal and the selected reduction color component. For example a weighted average of the panel intensity values for the color components with the smallest values can be calculated for each pixel.

The embodiments of the present invention have provided a detailed discussion of an OLED display having a white emitting layer with color filters. However, this method can be applied to any four-channel display having color channel dependent light-emission, including inorganic EL displays, plasma displays, field emissive displays, carbon nanotube displays or liquid crystal displays having a backlight that includes independently addressable red, green, and blue light sources. It is particularly useful for the liquid crystal display backlight to include numerous, individually controllable colors of illumination sources (e.g., arrays of individual red, green, and blue inorganic LEDs). It is notable that to obtain maximum power efficiency gains, it is useful to modulate the intensity of individual subpixels, such as is common in emissive displays, so that the power of each of the efficient subpixels can be reduced as a result of the method of the present invention.

In displays, such as liquid crystal displays, which include a light modulator and individually controllable colors of illumination sources, it is desirable that each of the controllable colors of illumination sources to be spatially subdivided. For example, the illumination source can be divided into arrays of individual red, green, and blue inorganic LEDs, wherein, each inorganic LED provides illumination to multiple subpixels. In such devices, the illumination of and therefore the power to each inorganic LED can be reduced to a level that is capable of providing the luminance required by the highest luminance subpixel within the area that is illuminated by the inorganic LED. Therefore, this inorganic LED will typically not provide as much power savings as is provided in a true emissive display in which the level of luminance that is produced by each subpixel can be individually modulated. In such displays, the method of the present invention can further take advantage of spatial relationships between subpixels to further reduce the luminance required from subpixels when relatively few of the subpixels within an area illuminated by an inorganic LED demand a higher luminance than the remaining subpixels by clipping the values of these high luminance subpixels to a lower value.

Other colors of subpixels than red, green, blue and white can be applied. For example, it can be desirable to use displays having red, green, and blue subpixels together with one or more of yellow or cyan subpixels. The method of the present invention will, however, have the most benefit when the four-channel display device includes a red channel, a green channel, a blue channel and one additional channel, the additional channel having a significantly higher luminous efficiency than the average of the luminance efficiencies of the red, green, and blue channels. It is desirable that the maximum luminous efficiency of the additional channel be at least 1.5 times the average luminous efficiency of the red, green, and blue channels. This requirement can be achieved in any device having a broadband subpixel with color filters. However, it can also be achieved in displays having patterned subpixels, either employed with or without color filters.

The invention has been described in detail with particular reference to certain preferred embodiments thereof, but it will be understood that variations and modifications can be effected within the spirit and scope of the invention.

PARTS LIST

2 receive image input signal step
4 select reduction color component step
6 calculate reduction factor step

8 select saturation adjustment factor step
10 produce image output signal step
12 provide display device step
14 apply image output signal step
16 select gain step
18 drive display step
22 display device
24R red subpixel
24G green subpixel
24B blue subpixel
24W white subpixel
26 pixel
28 controller
30 image input signal
32 image output signal
34 sensor
36 control signal
50 substrate
52 active matrix layer
54 red color filter
56 green color filter
58 blue color filter
60 clear, neutral-colored, or slightly colored filter
62 electrodes
64 pixel definition elements
66 hole transport layer
68 light-emitting layer
Parts List Continued
70 electron transport layer
72 second electrode layer
74 encapsulation layer
76 vector
80 chromaticity coordinate of red subpixel
82 chromaticity coordinate of green subpixel
84 chromaticity coordinate of blue subpixel
86 chromaticity coordinate of white subpixel
88 display gamut
90 chromaticity coordinate of input red
92 chromaticity coordinate of input green
94 chromaticity coordinate of input blue
96 output gamut
98 input gamut
100 set initial gain step
102 receive image input signal step
104 convert image input signal step
106 apply gain step
108 select reduction color component step
110 calculate channel reduction factor step
112 select saturation adjustment factor step
114 apply saturation adjustment factor step
116 produce image output signal step
118 count and clip step
120 provide image output signal step
122 determine number of color component values step
124 determine if scene change occurred step
126 calculate gain with large decrease step
128 calculate gain with small decrease step
Parts List Continued
132 determine if scene change occurred step
134 calculate gain with large gain increase step
136 calculate gain with small gain increase step
152 estimating unit
154 channel reduction factor calculation unit
156 saturation adjustment factor selection unit
158 factor application unit
160 optional gain selection unit
162 optional gain application unit
164 display drive unit
166 control signal
168 channel reduction factors
170 saturation adjustment factors

We claim:

1. A transmissive display system, comprising:

a) a display device comprising a plurality of pixels and a plurality of light sources,
wherein each pixel comprises four transmissive subpixels operable to transmit light of respective colors,
wherein the four colors are red, green, and blue, which define a color gamut, and white, which lies within the color gamut
wherein light sources for different color subpixels are independently variable;

b) a controller comprising:
i) a reduction factor calculation unit,
ii) a saturation adjustment factor selection unit,
iii) a factor application unit, and
iv) a display drive unit;

wherein the controller is configured to
i) receive an input image signal comprising a plurality of input pixel signals, each input pixel signal having three color components,
ii) process the input image signal to produce an output image signal, and
iii) provide the output image signal to the display device;

wherein the reduction factor calculation unit is configured to calculate a blue reduction factor for only the blue color component of each input pixel signal,
wherein the blue reduction factor is dependent on the differences in luminance of the blue color component and the other color components;

wherein the saturation adjustment factor selection unit is configured to produce respective saturation adjustment factors for each of the red, green, and blue color components,
wherein at least two of the saturation adjustment factors are unequal;

wherein the factor application unit is configured to apply the blue reduction factors to reduce luminance of the blue color component, and apply the saturation adjustment factors to reduce saturation of other color components; and wherein the display drive unit is configured to produce the output image signal,
wherein the output image signal has four color components which are red, green, blue, and white.

2. The transmissive display system of claim 1, further comprising a sensor operable to provide a control signal to the controller, and wherein the saturation adjustment factor unit is configured to produce saturation adjustment factors that are dependent upon the control signal.

3. The transmissive display system of claim 2, wherein the control signal is responsive to a battery lifetime signal, whereby the transmissive display system is configured to reduce power to the display device when the battery lifetime is low.

4. The transmissive display system of claim 2, wherein the control signal is responsive to a power type signal, whereby the transmissive display system is configured to reduce power to the display device when a limited type of power is applied.

5. The transmissive display system of claim 2, wherein the sensor is configured to adjust the control signal according to a type of input image, whereby the control signal is responsive to an input type signal.

6. The transmissive display system of claim 1, wherein the controller further comprises an estimating unit configured to receive the input image signal, analyze the input image signal, estimate the current required to display the input image signal, and provide a control signal to the saturation adjustment factor selection unit, wherein the saturation adjustment factor unit is configured to produce saturation adjustment factors that are dependent upon the control signal, and whereby the transmissive display system is configured to adjust the output image signal according to the current required to display the input image signal.

7. The transmissive display system of claim 1, wherein the controller further comprises a gain selection unit and a gain application unit respectively configured to select a luminance gain and apply the luminance gain to the input image signal.

8. The transmissive display system of claim 1, wherein the saturation adjustment factor for the blue color component is 1.0.

9. The transmissive display system of claim 1, wherein the controller is further configured to convert the input image signal from an input color space to primary colors of the display device.

10. The transmissive display system of claim 1, wherein the display is a liquid crystal display.

11. The transmissive display system of claim 1, wherein the light sources are individually controllable inorganic LEDs.

12. The transmissive display system of claim 11, wherein each inorganic LED provides illumination to a plurality of subpixels.

13. The transmissive display system of claim 12, wherein the system is configured to drive each inorganic LED at a level that is capable of providing the luminance required by the highest luminance subpixel within an area that is illuminated by the inorganic LED.

14. The transmissive display system of claim 12, wherein the system is configured to clip the luminance of high-luminance subpixels from among the plurality of subpixels illuminated by an inorganic LED.

* * * * *